US011371265B2

(12) United States Patent
Sonney

(10) Patent No.: US 11,371,265 B2
(45) **Date of Patent: *Jun. 28, 2022**

(54) HYBRID DRAWER HANDLE AND RELEASE MECHANISM

(71) Applicant: Allegis Corporation, Minneapolis, MN (US)

(72) Inventor: Tye S. Sonney, Lakeville, MN (US)

(73) Assignee: Allegis Corporation, Minneapolis, MN (US)

( * ) Notice: Subject to any disclaimer, the term of this patent is extended or adjusted under 35 U.S.C. 154(b) by 243 days.

This patent is subject to a terminal disclaimer.

(21) Appl. No.: 16/866,413

(22) Filed: May 4, 2020

(65) Prior Publication Data

US 2020/0263453 A1 Aug. 20, 2020

Related U.S. Application Data

(63) Continuation of application No. 16/414,345, filed on May 16, 2019, now Pat. No. 10,641,010.
(Continued)

(51) Int. Cl.

| | |
|---|---|
| ***E05B 65/46*** | (2017.01) |
| ***A47B 88/423*** | (2017.01) |
| ***A47B 88/919*** | (2017.01) |
| ***A47B 88/944*** | (2017.01) |
| ***A47B 88/938*** | (2017.01) |
| ***A47B 95/02*** | (2006.01) |
| ***E05B 7/00*** | (2006.01) |
| ***E05B 13/00*** | (2006.01) |

(52) U.S. Cl.
CPC ..... *E05B 65/46* (2013.01); *A47B 88/423* (2017.01); *A47B 88/919* (2017.01); *A47B 88/944* (2017.01); *A47B 2088/939* (2017.01)

(58) Field of Classification Search
CPC ..... E05B 65/46; E05B 13/002; E05B 7/00; A47B 88/944; A47B 88/423; A47B 88/919; A47B 2088/939; A47B 2095/022; A47B 2095/025
USPC ..... 70/85–88, 210, 224; 16/418, 438, 16/DIG. 24, DIG. 32; 292/336.3; 312/332.1
See application file for complete search history.

(56) References Cited

U.S. PATENT DOCUMENTS

| | | |
|---|---|---|
| 5,797,667 A | 8/1998 | Wu |
| 6,851,286 B2 | 2/2005 | Dube |

(Continued)

*Primary Examiner* — Lloyd A Gall
(74) *Attorney, Agent, or Firm* — Edwin E. Voigt, II; Vidas, Arrett & Steinkraus

(57) ABSTRACT

A drawer release mechanism has a handle having ends, a cylindrical portion and a flange. A pair of end cap interfaces are engaged to the ends of the handle. The end cap interfaces have rotational shafts, cylindrical receiving portions, receiving slots, and flange slots. A pair of end caps are exterior to the end cap interfaces, the end caps have flange recesses, rotation surfaces, shaft openings, and cam receiving areas, where the rotational shafts are disposed through the shaft openings, the receiving portions are adjacent to the rotation surfaces, and the flange slots are disposed in the flange recesses. The end caps are attached to a drawer. A cam is engaged to each of the rotational shafts. Each cam includes a shaft receiver, an actuator support and a cam actuator. The cams engage levers to release a drawer from a cabinet upon actuation of the handle.

21 Claims, 5 Drawing Sheets

Related U.S. Application Data

(60) Provisional application No. 62/699,215, filed on Jul. 17, 2018, provisional application No. 62/674,261, filed on May 21, 2018.

(56) References Cited

U.S. PATENT DOCUMENTS

| | | | | |
|---|---|---|---|---|
| 8,152,209 | B2 | 4/2012 | Lee | |
| 8,944,537 | B1 | 2/2015 | Manalang | |
| 9,388,609 | B2 | 7/2016 | Grela | |
| 10,004,331 | B2 | 6/2018 | Jeffries et al. | |
| 10,172,452 | B2 | 1/2019 | Hanley et al. | |
| 10,334,944 | B2 | 7/2019 | Hanley | |
| 10,455,937 | B2 | 10/2019 | Jeffries | |
| 10,472,853 | B2 | 11/2019 | Shah | |
| 10,641,010 | B2 * | 5/2020 | Sonney | E05B 13/002 |
| 2009/0016012 | A1 | 1/2009 | Huang | |
| 2009/0102333 | A1 | 4/2009 | Weng | |
| 2013/0076046 | A1 | 3/2013 | Shah | |
| 2018/0279781 | A1 | 10/2018 | Jeffries et al. | |

* cited by examiner

HYBRID DRAWER HANDLE AND RELEASE MECHANISM

CROSS-REFERENCE TO RELATED APPLICATIONS

This application is a continuation of U.S. Utility patent application Ser. No. 16/414,345 filed May 16, 2019 and issued as U.S. patent Ser. No. 10/641,010 on May 5, 2020, which claims the benefit of U.S. Provisional Patent Application Ser. No. 62/674,261 filed May 21, 2018, which is incorporated by reference herein in its entirety and which claims the benefit of U.S. Provisional Patent Application Ser. No. 62/699,215 filed Jul. 17, 2018, which is incorporated by reference herein in its entirety.

FIELD OF THE INVENTION

The invention is directed to a handle mechanism as attached to a sliding drawer, where the handle may be lifted/rotated to actuate a latch integral to a cabinet, the handle mechanism being used to release the drawer slide from a secured position relative to the cabinet.

BACKGROUND

Extruded handles which are pivotally engaged to a drawer, drawer slide and cabinet, which have been used to provide access into a drawer, are generally known. The known handle mechanisms are generally engaged to an elongated shaft disposed the entire length in front of the drawer between the sides of a cabinet. The known release mechanisms have been relatively complicated and costly to manufacture, maintain and service.

In addition, the known handles, drawer slides and cabinets, have been difficult to adapt for use in a vehicle due to the inadvertent release of the latching mechanism of the drawers during movement of the vehicle. Unintentional release of the drawer latch results in the sliding of the drawer outwardly from the cabinet, and the spewing of the contents of the drawer within the interior of the vehicle.

The art referred to and/or described above is not intended to constitute an admission that any patent, publication or other information referred to herein is "prior art" with respect to this invention. In addition, this section should not be construed to mean that a search has been made or that no other pertinent information as defined in 37 C.F.R. § 1.56(a) exists.

All U.S. patents and applications and all other published documents mentioned anywhere in this application are incorporated herein by reference in their entireties.

Without limiting the scope of the invention, a brief description of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided for the purposes of complying with 37 C.F.R. § 1.72.

GENERAL DESCRIPTION OF THE INVENTION

The hybrid drawer handle and release mechanism invention uses an elongate handle having opposite ends. Each of the ends are inserted into an end cap interface. Each of the end cap interfaces include a rotation shaft. The rotation shafts are inserted into an opening in a curved receiver of an end cap assembly. The handle is permitted to pivot upwardly and downwardly relative to a drawer through the rotational engagement of the end cap interfaces relative to the curved receivers of the end cap assemblies. A latch actuating cam is non-rotatably secured to the rotation shaft and is disposed behind the curved receiver. The latch actuating cam engages a latch engaged to a drawer slide, which is constructed and arranged to release a drawer from the cabinet, permitting the drawer to be opened through the pulling of a drawer outwardly from the cabinet through the use of the drawer slides.

In one alternative embodiment, the a drawer release mechanism includes a handle having a first end, a second end, a first cylindrical portion proximate to the first end and a second cylindrical portion proximate to the second end.

In another embodiment the handle also includes a grasping edge extending between the first end and the second end and a first flange portion extending outwardly and rearwardly from the cylindrical portion proximate to the first end, and a second flange portion extending outwardly and rearwardly from the cylindrical portion proximate to the second end.

In another embodiment a first end cap interface is engaged to the first end and a second end cap interface is engaged to the second end, the first end cap interface having a first interface rotational shaft, a first cylindrical receiving portion opposite to the first interface rotational shaft, a first handle receiving slot, and a first flange receiving slot.

In another embodiment, the first cylindrical receiving portion releasably engages the first cylindrical portion, the first handle receiving slot releasably engages a portion of the first end, and the first flange receiving slot is releasably engaged to the first flange portion.

In an alternative embodiment the second end cap interface has a second interface rotational shaft, a second cylindrical receiving portion opposite to the second interface rotational shaft, a second handle receiving slot, and a second flange receiving slot.

In another embodiment the second cylindrical receiving portion releasably engages the second cylindrical portion, the second handle receiving slot releasably engages a portion of the second end, and the second flange receiving slot releasably engages the second flange portion.

In another alternative embodiment, a first end cap is proximate and exterior to the first end cap interface, the first end cap having a first end cap flange recess, a first end cap rotation surface, a first shaft opening, and a first rear cam receiving area.

In another alternative embodiment the first interface rotational shaft is disposed through the first shaft opening, the first cylindrical receiving portion is positioned adjacent to the first end cap rotation surface and the first flange receiving slot is disposed in the first end cap flange recess.

In another alternative embodiment a second end cap is proximate and exterior to the second end cap interface, the second end cap having a second end cap flange recess, a second end cap rotation surface, a second shaft opening, and a second rear cam receiving area.

In another alternative embodiment the second interface rotational shaft is disposed through the second shaft opening, the second cylindrical receiving portion is positioned adjacent to the second end cap rotation surface and the second flange receiving slot is disposed in the second end cap flange recess.

In another alternative embodiment the first end cap and the second end cap are constructed and arranged for attachment to the front wall of a drawer In another alternative embodiment a first cam has a first rotational shaft receiver, a first actuator support, and a first cam actuator extending outwardly from the first actuator support opposite to the first rotational shaft receiver.

In another alternative embodiment the first cam is disposed in the first rear cam receiving area and the first interface rotational shaft is disposed in the first rotational shaft receiver.

In another alternative embodiment a second cam has a second rotational shaft receiver, a second actuator support, and a second cam actuator extending outwardly from the second actuator support opposite to the second rotational shaft receiver.

In another alternative embodiment the second cam is disposed in the second rear cam receiving area and the second interface rotational shaft is disposed in the second rotational shaft receiver.

In another alternative embodiment a first spring is engaged to the first cam and to the first rear cam receiving area and a second spring is engaged to the second cam and to the second rear cam receiving area.

In another alternative embodiment first end cap interface and the second end cap interface are reverse elements relative to each other, the first end cap and the second end cap are reverse elements relative to each other, and the first cam and the second cam are reverse elements relative to each other.

In another alternative embodiment the drawer release mechanism further comprises a central support, the central support being constructed and arranged for attachment to the front wall of the drawer between the first end and the second end.

In another alternative embodiment the central support has a rear wall, a central support flange recess and a central support rotation surface, where the central support flange recess rotatably receives a portion of the first flange or the second flange, and the central support rotation surface rotatably receives a portion of the first cylindrical portion or the second cylindrical portion.

In another alternative embodiment the first end cap further includes a first interior vertical wall, a first intermediate vertical wall and a first exterior vertical wall, where the first shaft opening passes through the first intermediate vertical wall, the first end cap flange recess and the first end cap rotation surface are disposed between the first interior vertical wall and the first intermediate vertical wall.

In another alternative embodiment the first end cap has a first end cap positioning surface below the first end cap rotation surface, and the first rear cam receiving area is located rearwardly of a first end cap front face between the first exterior vertical wall and the first intermediate vertical wall.

In another alternative embodiment the second end cap includes a second interior vertical wall, a second intermediate vertical wall and a second exterior vertical wall, where the second shaft opening passes through the second intermediate vertical wall.

In another alternative embodiment the second end cap flange recess and the second end cap rotation surface are disposed between the second interior vertical wall and the second intermediate vertical wall.

In another alternative embodiment the second end cap has a second end cap positioning surface below the second end cap rotation surface, and the second rear cam receiving area is located rearwardly of a second end cap front face between the second exterior vertical wall and the second intermediate vertical wall.

In another alternative embodiment the first cam includes a first stop having a first ledge, where the first stop descends from at least one of the first rotational shaft receiver, the first actuator support and the first cam actuator.

In another alternative embodiment the second cam has a second stop having a second ledge, where the second stop descends from at least one of the second rotational shaft receiver, the second actuator support and the second cam actuator.

In another alternative embodiment the first end cap has a first lock opening disposed through the first end cap front face, the first lock opening receives a first lock, the first lock having a first block surface, the first lock having a first locking position where the first block surface is disposed proximate to and below the first ledge, the first lock having a first unlocked position wherein the first block surface is rotated downwardly away from the first ledge.

In another alternative embodiment the second end cap has a second lock opening disposed through the second end cap front face, the second lock opening receiving a second lock, the second lock having a second block surface, the second lock having a second locking position where the second block surface is disposed proximate to and below the second ledge, the second lock has a second unlocked position where the second block surface is rotated downwardly away from the second ledge.

In a another alternative embodiment the first cam actuator is positioned proximate to and above a first latch release lever and the second cam actuator is positioned proximate to and above a second latch release lever.

In an alternative embodiment rotation of the handle upwardly from an at rest position moves the first cam actuator downwardly against the first latch release lever and moves the second cam actuator downwardly against the second latch release lever.

In an alternative embodiment the first handle receiving slot has a first interior handle receiving slot surface and the second handle receiving slot has a second interior handle receiving slot surface and further wherein in the at rest position the first interior handle receiving slot surface is disposed proximate to the first end cap positioning surface and the second interior handle receiving slot surface is disposed proximate to the second end cap positioning surface.

In an alternative embodiment the first flange recess has a first upper rotational stop edge and a first lower rotational stop edge and the second flange recess have a second upper rotational stop edge and a second lower rotational stop edge.

In an alternative embodiment the central support flange recess has a support upper rotational stop edge and a support lower rotational stop edge.

In an alternative embodiment the rear wall is horizontal.

In an alternative embodiment the first end cap front face and the second end cap front face have an identical shape.

In an alternative embodiment the shape of the first and second end cap front faces is rectangular.

In an alternative embodiment the shape of the first and second end cap front faces is oval.

In an alternative embodiment the shape of the first and second end cap front faces is bullet shaped.

In an alternative embodiment the handle has at least two outwardly extending ridges defining a handle channel, the handle channel being constructed and arranged for receipt of a label.

These and other embodiments which characterize the invention are pointed out with particularity in the claims annexed hereto and forming a part hereof. However, for further understanding of the invention, its advantages and objectives obtained by its use, reference should be made to the drawings which form a further part hereof and the accompanying descriptive matter, in which there is illustrated and described embodiments of the invention.

DETAILED DESCRIPTION OF THE PREFERRED EMBODIMENTS

Figure 1:
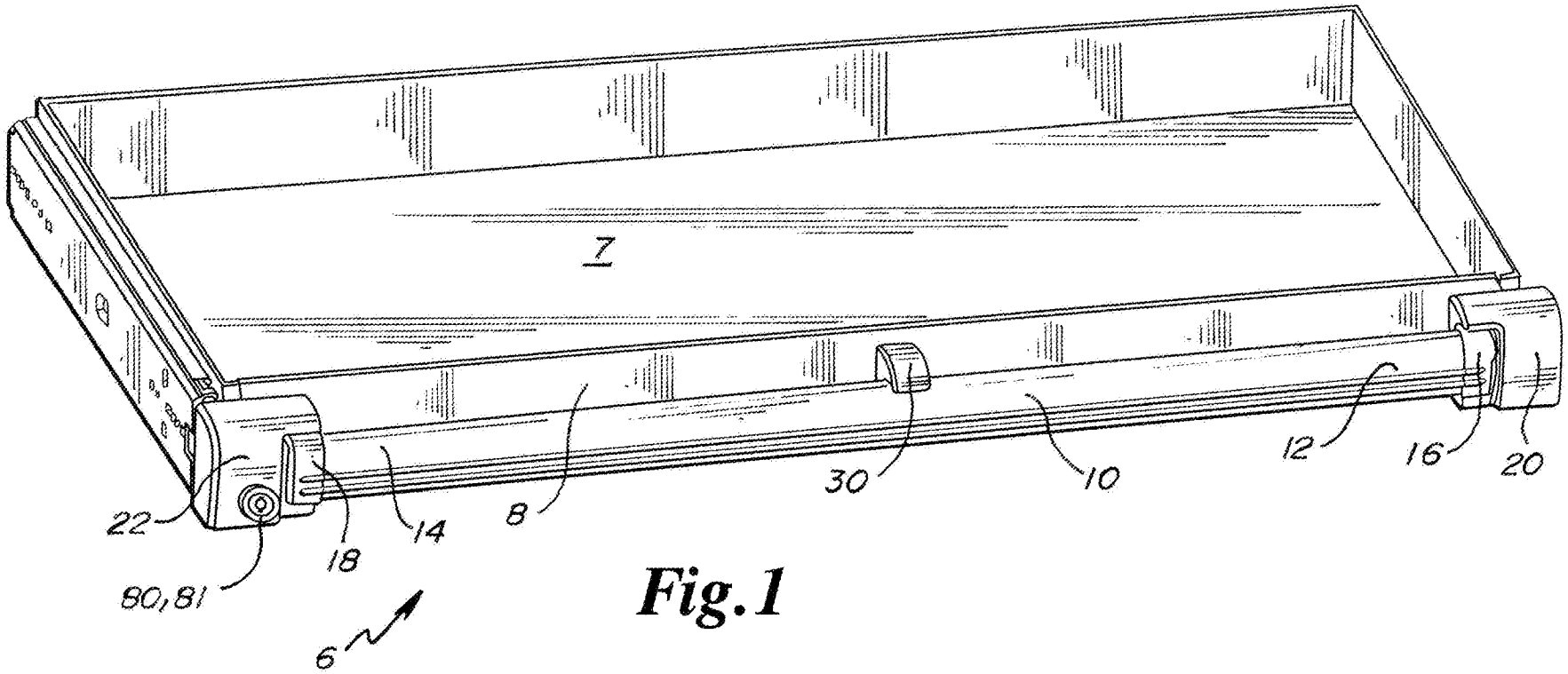
FIG. 1 is an isometric perspective view of one alternative embodiment of the drawer handle and release mechanism invention.

In general the hybrid drawer handle and release mechanism is referred to by numeral 6. The hybrid drawer handle and release mechanism 6 is generally engaged to a drawer 7 having a front wall 8.

The hybrid drawer handle and release mechanism 6 preferably includes a handle 10 having a first handle end 12 and a second handle end 14. Each of the respective first and second handle ends 12, 14 are inserted into a first end cap interface 16 and a second end cap interface 18. In at least one embodiment, the first end cap interface 16 is rotatably engaged to a first end cap 20 and the second end cap interface 18 is rotatably engaged to a second end cap 22.

In a preferred embodiment, an interior or central portion of the handle 10 is disposed within and is pivotal relative to a central support 30. The central support 30 is preferably centrally affixed to the front wall 8 approximately equal distances between the first handle end 12 and the second handle end 14.

Figure 11:
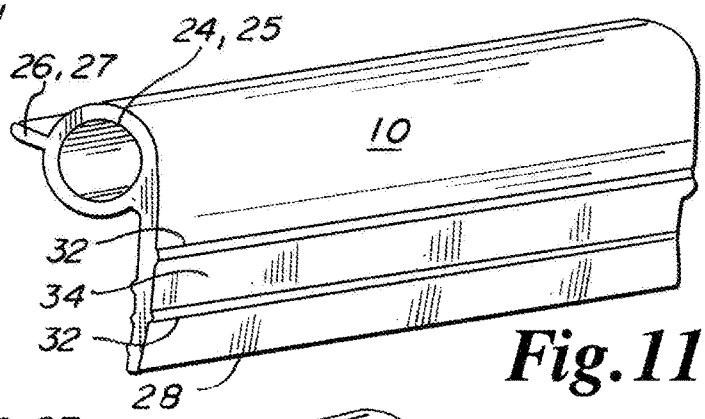
FIG. 11 is a detail isometric perspective view of one alternative embodiment of a handle of the drawer handle and release mechanism invention.
Figure 12:
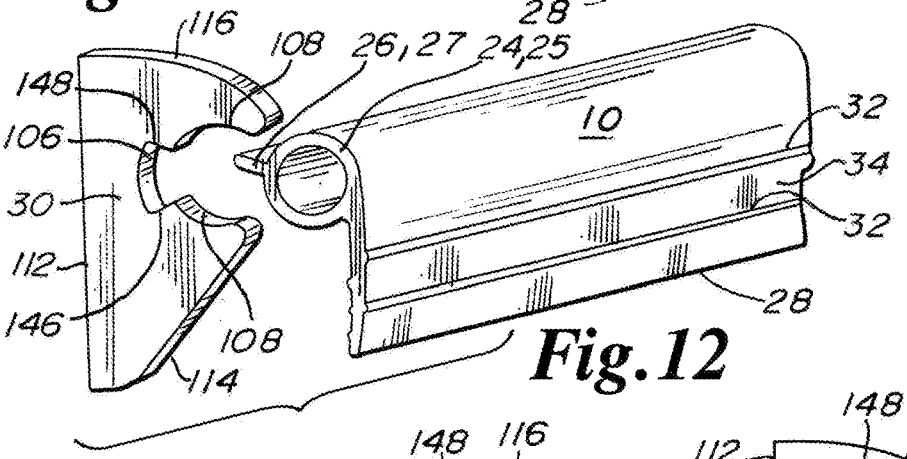
FIG. 12 is a detail isometric perspective view of one alternative embodiment of a central support and handle of the drawer handle and release mechanism invention.
Figure 13:
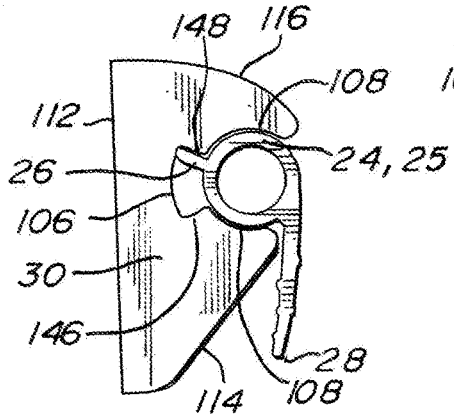
FIG. 13 is a detail side elevation view of one alternative embodiment of a central support and handle of the drawer handle and release mechanism invention.
Figure 14:
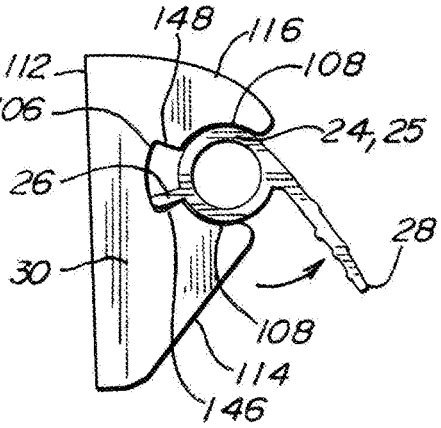
FIG. 14 is a detail side elevation view of another alternative embodiment of a central support and handle of the drawer handle and release mechanism invention.
Figure 15:
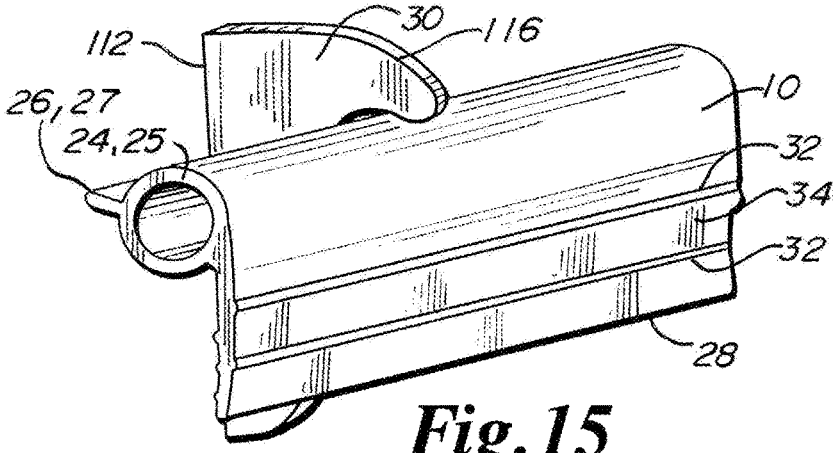
FIG. 15 is a detail isometric perspective view of an alternative embodiment of a central support and handle of the drawer handle and release mechanism invention.

In at least one embodiment as depicted in FIGS. 11, 12 and 15, the handle 12 includes an upper cylindrical portion 24 and a flange 26. The flange 26 preferably extends longitudinally along the length of the cylindrical portion 24 between the first and second handle ends 12, 14. The flange 26 also preferably extends rearwardly and normally outwardly from the cylindrical portion 24. In at least one embodiment the flange 26 is not required to be continuous between the first and second ends 12, 14 respectively, and may be formed into flange portions. In at least one embodiment a first flange portion 27 is proximate to a first handle end 12 and a second flange portion 26 is proximate to a second handle end 14. In addition a flange portion may also be centrally disposed between the first end 12 and the second end 14 for positioning within the central support 30.

In at least one embodiment the handle 10 is continuous between the first end 12 and second end 14 having a front face and a lower grasping edge 28. The front face may have any height dimension as desired by a user which in some embodiments be larger than 3, 5, or 7 inches and in other embodiments may be smaller than 3, 5, or 7 inches.

In at least one embodiment, the front face of the handle 10, may include at least two parallel outwardly extending ridges 32 defining a channel 34 therebetween. In some embodiments, channel 34 may be used to receive a label identifying the contents of the drawer 7.

The hybrid drawer and release handle mechanism 6 includes a first end cap interface 16 and a second end cap interface 18. The first and second end cap interfaces 16, 18 preferably include identical features and functions, and are reverse images relative to each other. The features of the second end cap interface 18 will be described herein where the features of the first end cap interface 16 will be identical to the second end interface 18.

Figure 8:
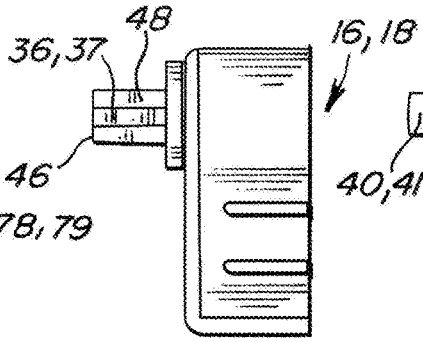
FIG. 8 is a detail side elevation view of one alternative embodiment of an end cap interface of the drawer handle and release mechanism invention.
Figure 9:
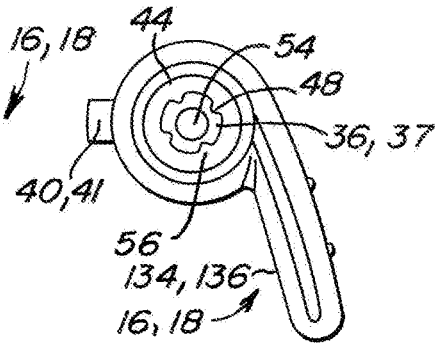
FIG. 9 is a detail front elevation view of one alternative embodiment of an end cap interface of the drawer handle and release mechanism invention.
Figure 10:
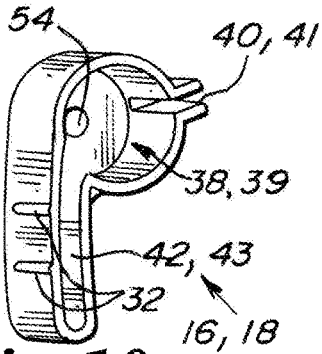
FIG. 10 is a detail rear isometric view of one alternative embodiment of an end cap interface of the drawer handle and release mechanism invention.

As may be seen in FIGS. 8, 9, and 10, in one embodiment a second end cap interface 18 includes an outwardly and normally extending interface rotation shaft 36, a cylindrical receiving portion 38, a flange receiving slot 40, a handle receiving slot 42, and a circular positioning ring 44 surrounding the interface rotational shaft 36. The circular positioning ring 44 is preferably opposite to the cylindrical receiving portion 38 having a wall therebetween.

The first end cap interface 16 includes an interface rotation shaft 37, a cylindrical receiving portion 39, a flange receiving slot 41, a handle receiving slot 43, and a circular positioning ring 44.

First and second end cap interfaces 16, 18 are preferably disposed over a respective first and second handle ends 12, 14. In both instances the exterior edge of the handle 10 is inserted into the handle receiving slots 42, 43; the exterior edge of the cylindrical portion 24 is inserted into the cylindrical receiving portions 38, 39; and the exterior edge of the flange 26 is inserted into the flange receiving slots 40, 41, releasably securing the first end cap interface 16 to the first handle end 12 and the second end cap interface 18 to the second handle end 14. The interface rotational shafts 36, 37 for each of the first and second end cap interfaces 16, 18 extend outwardly and normally from a location which is centered relative to the cylindrical receiving portion 38, 39 of the respective first and second end cap interfaces 16, 18.

In at least one embodiment the respective interface rotational shafts 36, 37 provide for pivotal manipulation of the handle 10 relative to a drawer 7 and the respective first and second end caps 20, 22.

In at least one embodiment, the handle 10 is formed of extruded aluminum material. The handle 10 in alternative embodiments may be formed of plastic, wood, other metallic materials, fiberglass, composite materials and any desired combination thereof.

In at least one embodiment, the first and second end cap interfaces 16, 18 may be formed of plastic, wood, metallic materials, fiberglass, composite materials and combinations thereof.

In at least one embodiment, the forward face of each of the first and second end cap interfaces 16, 18 include parallel outwardly extending ridges 32 aligned with the ridges 32 of the face of the handle 10.

In a preferred embodiment, the interface rotational shafts 36, 37 include an outer end 46 and a plurality of interface shaft grooves 48. In some embodiments the interface shaft grooves 48 facilitate engagement with the respective first cam 50 and second cam 52 preventing rotational slippage therebetween during use of the hybrid drawer handle and release mechanism 6.

In at least one embodiment, the interface rotational shafts 36, 37 include a centrally located elongate interface aperture 54 which extends through an interior wall of the first and second end cap interfaces 16, 18. The interface aperture 54 extends through the entire length of the interface rotational shafts 36, 37.

In another preferred embodiment, as may be seen in FIGS. 9 and 10, the upper exterior portion of the cylindrical receiving portions 38, 39 are curved to reflect the shape of the cylindrical portion 24 of the handle 10.

In some embodiments, a circular interface positioning depression 56 is located between the circular positioning ring 44 and the interface rotational shaft 36, 37. The interface positioning depression 56 preferably receives the circular end cap alignment guide 58 of the respective first end cap 20 or second end cap 22 during the attachment of the handle 10 to the first and second end caps 20, 22.

In a preferred embodiment, the first and second end caps 20, 22 preferably include identical features and functions and are reverse images relative to each other. For convenience, the features of the second end cap 22 will be described herein, where the features of the first end cap 20 will be identical to the second end cap 22.

In at least one embodiment, the first and second end caps 20, 22 may be formed of plastic, wood, metallic materials, fiberglass, composite materials and combinations thereof.

In at least one embodiment as seen in FIGS. 2, 4, 5, 6, and 7 second end cap 22 is proximate to the second end cap interface 18 and includes a flange recess 60, an end cap rotational surface 62, an end cap positioning surface 64, a curved receiver 66 and an opening 68.

The first end cap 20 is proximate to the first end cap interface 16 and includes a flange recess 61, an end cap rotational surface 63, an end cap positioning surface 65, a curved receiver 66 and an opening 69.

The second end cap interface 18 preferably is sized and shaped for positioning of the flange receiving slot 40 within the flange recess 60 and the positioning of the exterior surface of the cylindrical receiving portion 38 within and proximate to the end cap rotational surface 62. The interior surface of the handle receiving slot 42 is also positioned proximate to the end cap positioning surface 64 following assembly of the hybrid drawer handle and release mechanism 6. In this embodiment, the interface rotational shaft 36 passes through the opening 68 into the interior of the second end cap 22.

The first end cap interface 16 preferably is sized and shaped for positioning of the flange receiving slot 41 within the flange recess 61 and the positioning of the exterior surface of the cylindrical receiving portion 39 within and proximate to the end cap rotational surface 63. The interior surface of the handle receiving slot 43 is also positioned proximate to the end cap positioning surface 65 following assembly of the hybrid drawer handle and release mechanism 6. In this embodiment, the interface rotational shaft 37 passes through the opening 69 into the interior of the first end cap 20.

In one embodiment, the flange 26 as positioned within the flange receiving slot 40, and the positioning of the flange receiving slot 40 within the flange recess 60 enables the handle 10 to be pivotally raised and lowered, where the flange 26 and flange receiving slot 40 move in an arc within the flange recess 60. It should be noted that the upper rotational stop edge 138 and the lower rotational stop edge 140 of the flange recess 60 function as rotational limiting members for the rotation of the handle 10 during use of the hybrid drawer handle and release mechanism 6. Further, the end cap rotational surface 62 functions as a bearing surface for the outer surface of the cylindrical receiving portion 38 during the raising and lowering of the handle 10. In some embodiments the end cap alignment guide 58 is fully inserted within the interface positioning depression 56 during use of the hybrid drawer handle and release mechanism 6.

In one embodiment, the flange 27 as positioned within the flange receiving slot 41, and the positioning of the flange receiving slot 41 within the flange recess 61 enables the handle 10 to be pivotally raised and lowered, where the flange 27 and flange receiving slot 41 move in an arc within the flange recess 61. It should be noted that the upper rotational stop edge 142 and the lower rotational stop edge 144 of the flange recess 61 function as rotational limiting members for the rotation of the handle 10 during use of the hybrid drawer handle and release mechanism 6. Further, the end cap rotational surface 63 functions as a bearing surface for the outer surface of the cylindrical receiving portion 39 during the raising and lowering of the handle 10. In some embodiments the end cap alignment guide 58 is fully inserted within the interface positioning depression 56 during use of the hybrid drawer handle and release mechanism 6.

Figure 7:
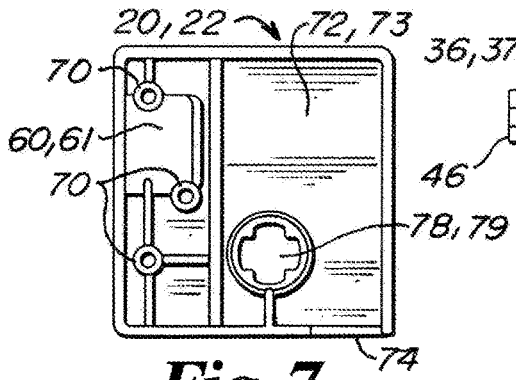
FIG. 7 is a detail rear elevation view of one alternative embodiment of an end cap of the drawer handle and release mechanism invention.

As may be seen in FIG. 7 the rear of the second end cap 22 includes a first rectangular portion which includes a plurality of fastener receivers 70. The rear surface of the flange recess 60 may be located adjacent to the fastener receivers 70. In some embodiments, fasteners 71 may pass from the interior of a drawer 7 outwardly and into the fastener receivers 70 to order to secure the second end cap 22 to the exterior surface of the front wall 8 of the drawer 7.

The rear of the first end cap 20 includes a first rectangular portion which includes a plurality of fastener receivers 70. The interior surface of the flange recess 61 may be seen to be located adjacent to the fastener receivers 70. In some embodiments, fasteners 71 may pass from the interior of a drawer 7 outwardly and into the fastener receivers 70 to order to secure the first end cap 20 to the exterior surface of the front wall 8 of the drawer 7.

Adjacent to a first rectangular portion is located a cam receiving area 72, 73. During assembly of the hybrid drawer handle and release mechanism 6, the first and second cams 50, 52 are located within the cam receiving areas 72, 73 within the interior of the first and second end caps 20, 22. In at least one embodiment, the lower surface of the first and second end caps 20, 22 may include an access notch 74.

Figure 16:
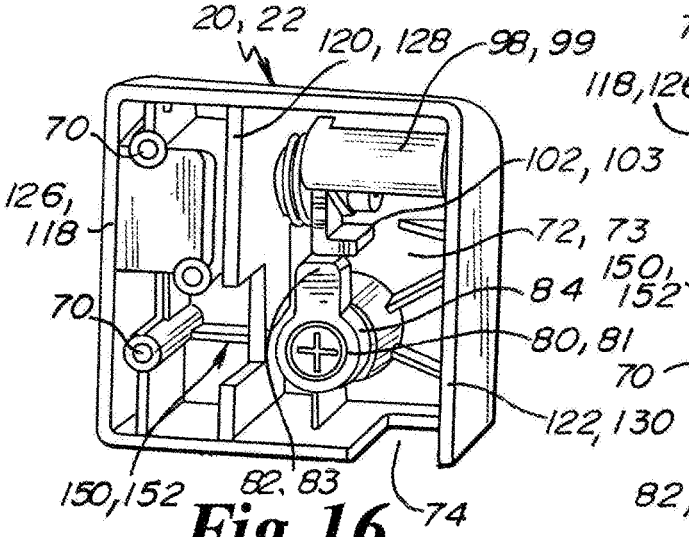
FIG. 16 is a rear detail isometric perspective view of an alternative embodiment of an end cap, cam and locking cylinder of the drawer handle and release mechanism invention.
Figure 17:
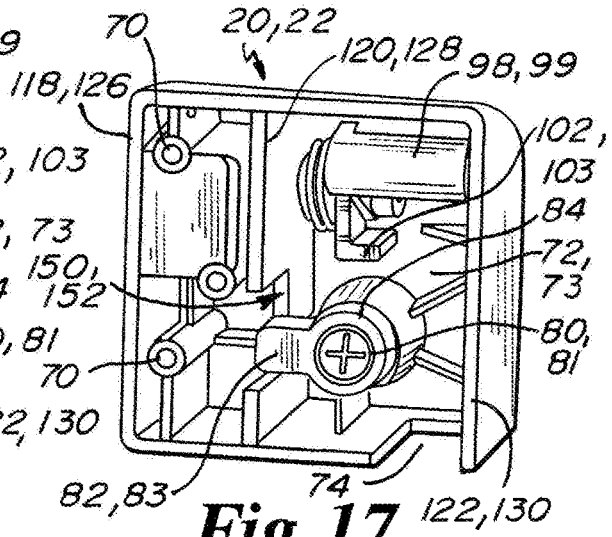
FIG. 17 is a rear detail isometric perspective view of an alternative embodiment of an end cap, cam and locking cylinder of the drawer handle and release mechanism invention.

As may be seen in FIGS. 2, 3, 4 and 5 the first and second end caps 20, 22 may include lock cylinder openings 78, 79 which may include internal structure to minimize risk of rotation of a lock cylinder 80, 81 following insertion into the lock cylinder openings 78, 79. The lock cylinders 80, 81 may be locked or unlocked through the use of a key (not shown). As may be seen in FIG. 16 through FIG. 18, the interior portion of the rear of the lock cylinders 80, 81 include an upwardly extending and inversely orientated u-shaped block 82, 83. The block 82, 83 may be rotated downwardly approximately 90° when the lock cylinder 80, 81 is manipulated from a locked position to an unlocked position. In some embodiments the block 82, 83 is rotated in clockwise direction and in the other embodiments the block 82, 83 is rotated in a counter-clockwise direction.

In at least one embodiment the block 82, 83 is integral to a body 84 which encircles and engages the rear end of the lock cylinders 80, 81. It should be noted that the elements and features described for the first end cap 20 are identical to the second end cap 22, the first end cap 20 being a reverse image of the second end cap 22. As may be seen in FIGS. 16, 17 and 18 in some embodiments the rear surface of first and second intermediate vertical walls 120, 128 may include a block slot 150, 152 to facilitate the rotational movement of the respective catch 82, 83 relative to the rear or interior of the first and second end caps 20, 22.

In at least one alternative embodiment, a spring 86 is disposed around the rotational shaft receiver 92 of the second cam 52. A first end 88 of spring 86 is disposed within the interior of the second end cap 22. A second end 90 of spring 86 is engaged to a second cam 52 within the interior of the second end cap 22. A spring 87 is disposed around the rotational shaft receiver 93 of the first cam 50. A first end 88 of spring 87 is disposed within the interior of the first end cap 20. A second end 90 of spring 87 is engaged to a first cam 50 within the interior of the first end cap 20.

In at least one embodiment, the first and second cams 50, 52 may be formed of plastic, wood, metallic materials, fiberglass, composite materials and combinations thereof.

Figure 2:
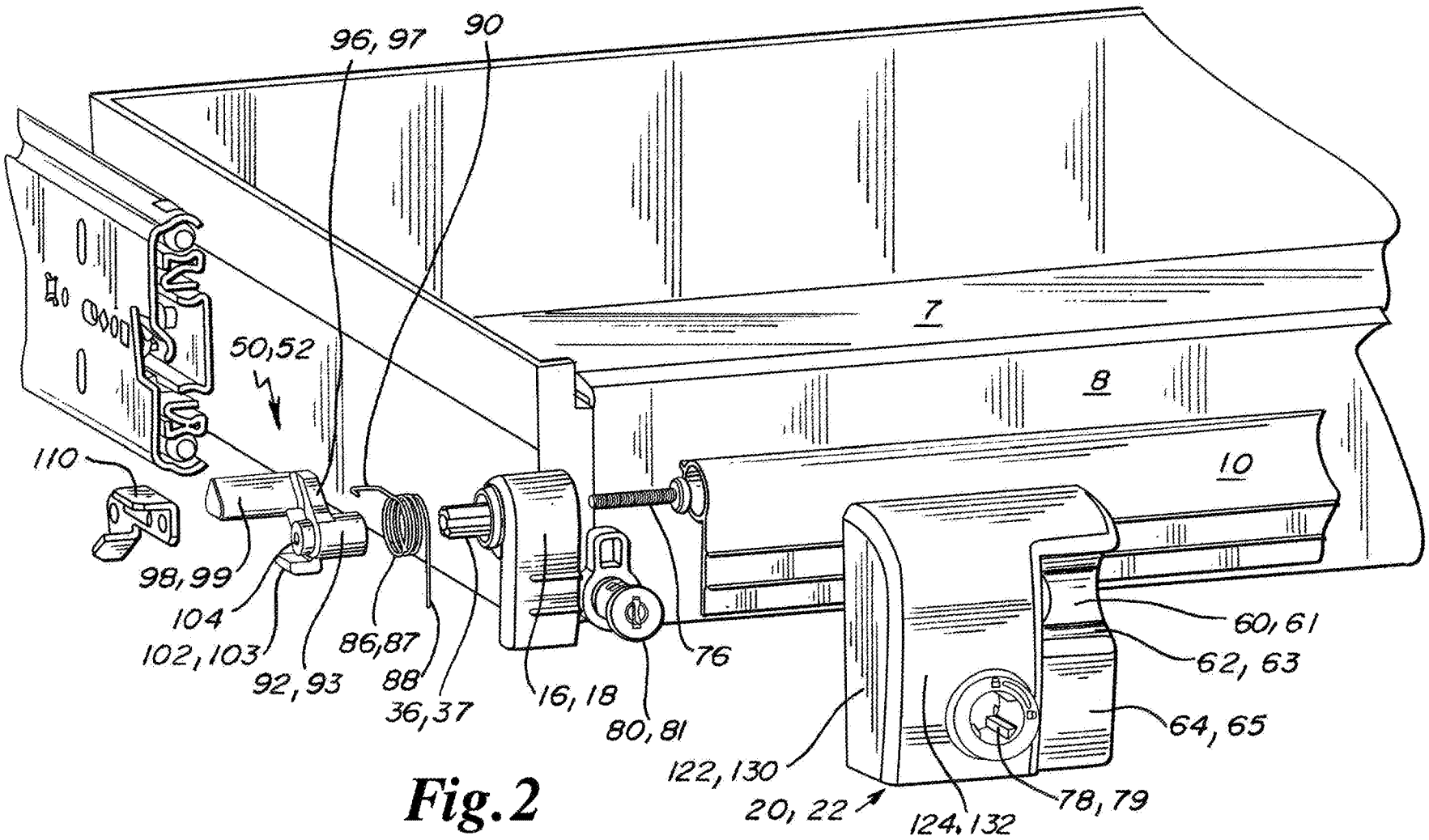
FIG. 2 is a partial detail exploded isometric view of one alternative embodiment of the drawer handle and release mechanism invention.
Figure 3:
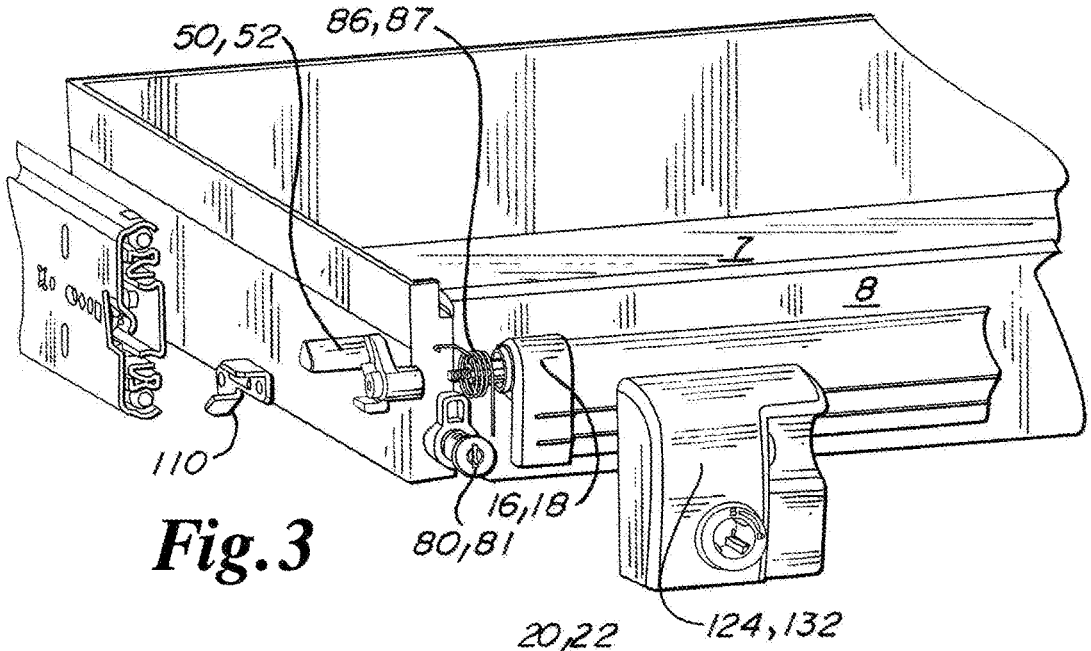
FIG. 3 is a partial detail exploded isometric view of another alternative embodiment of the drawer handle and release mechanism invention.
Figure 4:
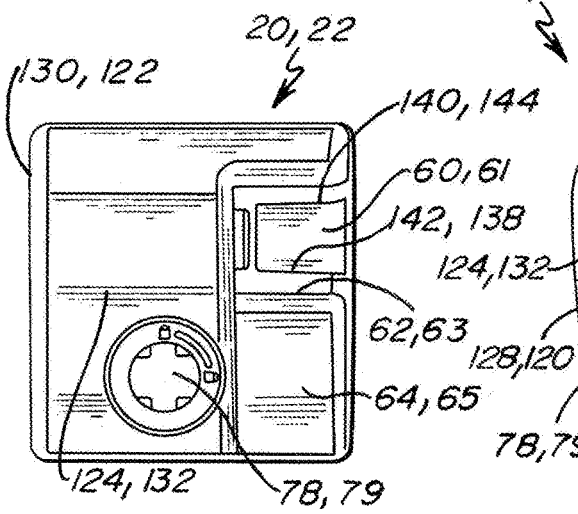
FIG. 4 is a detail front elevation view of one alternative embodiment of an end cap of the drawer handle and release mechanism invention.
Figure 5:
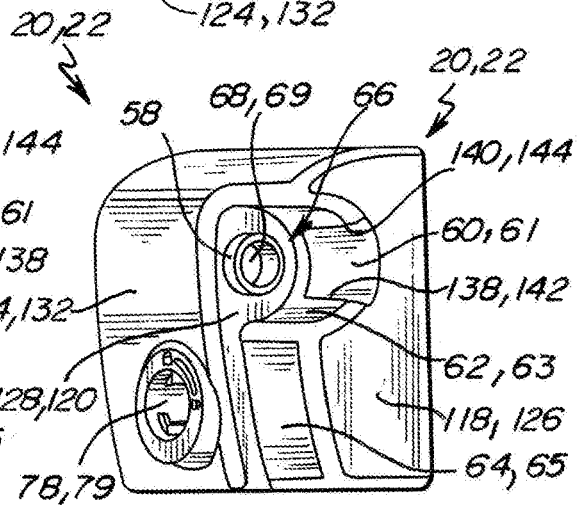
FIG. 5 is a detail isometric view of one alternative embodiment of an end cap of the drawer handle and release mechanism invention.
Figure 6:
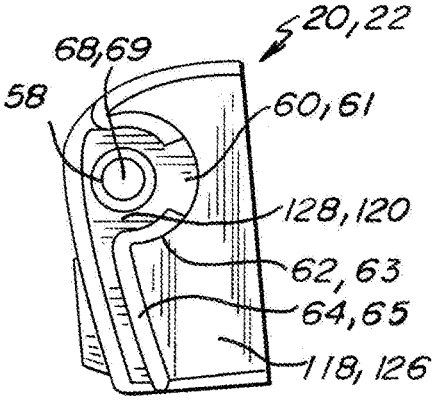
FIG. 6 is a detail side elevation view of one alternative embodiment of an end cap of the drawer handle and release mechanism invention.
Figure 20:
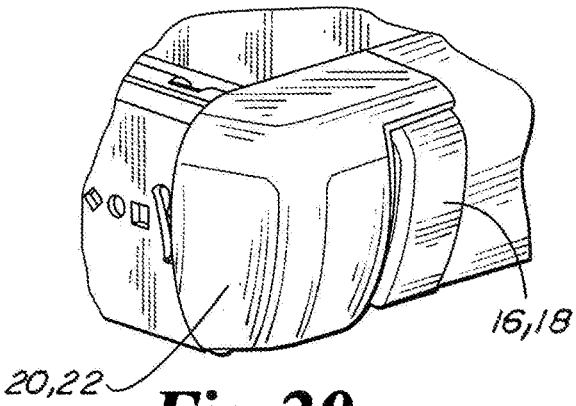
FIG. 20 is an isometric perspective front view of an alternative embodiment of an end cap of the drawer handle and release mechanism invention.
Figure 19:
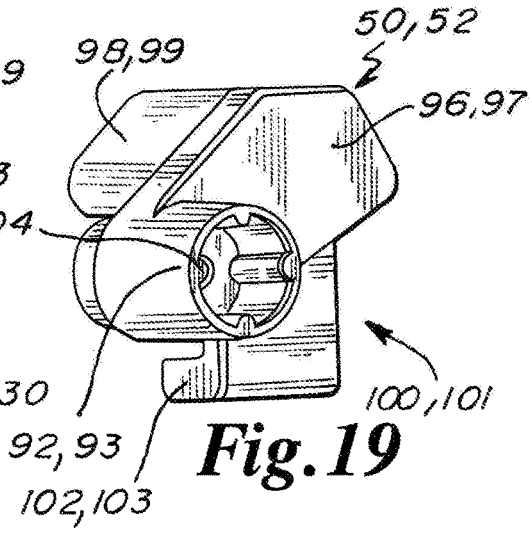
FIG. 19 is an isometric perspective view of an alternative embodiment of a cam of the drawer handle and release mechanism invention.

In at least one embodiment as may be seen in FIGS. 2 and 19 a second cam 52 includes a cylindrical rotational shaft receiver 92. The rotational shaft receiver 92 internally includes a plurality of protrusion members 94 which are inserted into and couple with the interface shaft grooves 48 to prevent rotation between the interface rotational shaft 36 and the second cam 52. A first cam 50 includes a cylindrical rotational shaft receiver 93. The rotational shaft receiver 93 internally includes a plurality of protrusion members 94 which are inserted into and couple with the interface shaft grooves 48 to prevent rotation between the interface rotational shaft 37 and the second cam 50.

In at least one embodiment the second cam 52 includes an upwardly and rearwardly extending actuator support 96. At the upper portion of the actuator support 96 a triangular-shaped cam actuator 98 extends in a direction opposite to the rotational shaft receiver 92. The first cam 50 includes an upwardly and rearwardly extending actuator support 97. At the upper portion of the actuator support 97 a triangular-shaped cam actuator 99 extends in a direction opposite to the rotational shaft receiver 93.

In some embodiments an L-shaped stop 100 extends downwardly from the cam actuator 98 to a position below the rotational shaft receiver 92. A ledge 102 of the L-shaped stop 100 is positioned directly above the block 82 when the lock cylinder 80 is in a locked position. (FIG. 16) The positioning of the ledge 102 directly above the block 82 causes the ledge 102 to contact the upper surface of the block 82 when the lock cylinder 80 is in the locked position. Efforts to raise the handle 10 in the locked position are prohibited because the block 82 prevents rotation of the ledge 102, second cam 52, second end cap interface 18, and handle 10.

Figure 18:
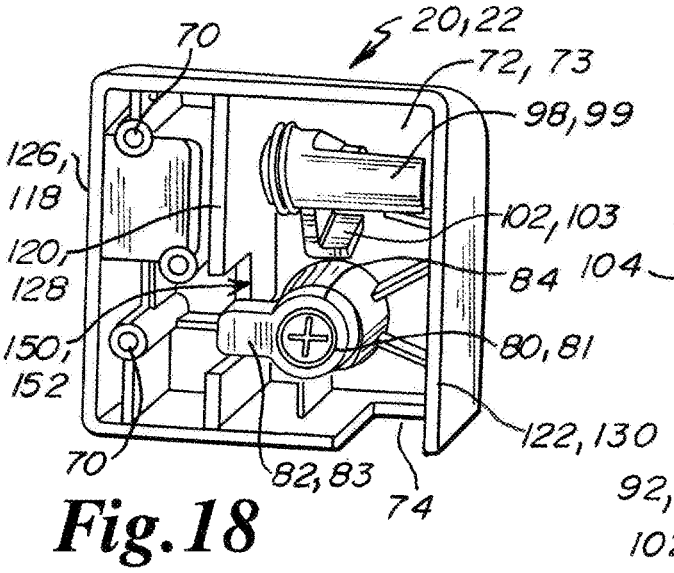
FIG. 18 is a rear detail isometric perspective view of an alternative embodiment of an end cap, cam and locking cylinder of the drawer handle and release mechanism invention.

Unlocking of the lock cylinder 80 in one embodiment rotates the block 82 approximately 90 degrees in a clockwise direction as viewed from the front. (FIG. 17) The rotation of block 82 creates space directly under ledge 102, permitting rotation of handle 10, second end cap interface 18 and second cam 52 to activate the latch release lever 110 from the drawer 7 and slide. (FIG. 18)

In some embodiments an L-shaped stop 101 extends downwardly from the cam actuator 99 to a position below the rotational shaft receiver 93. A ledge 103 of the L-shaped stop 101 is positioned directly above the block 83 when the lock cylinder 81 is in a locked position. The positioning of the ledge 103 directly above the block 83 causes the ledge 103 to contact the upper surface of the block 83 when the lock cylinder 81 is in the locked position. Efforts to raise the handle 10 in the locked position are prohibited because the block 83 prevents rotation of the ledge 103, first cam 50, first end cap interface 16, and handle 10.

Unlocking of the lock cylinder 81 in one embodiment rotates the block 83 approximately 90 degrees in a clockwise direction. (FIG. 17) The rotation of block 83 creates space directly under ledge 103, permitting rotation of handle 10, first end cap interface 16 and first cam 50 to activate the latch release lever 110 from the drawer 7 and slide. (FIG. 18) In at least one embodiment the interior end wall of the rotational shaft receiver 92 and the actuator support 96 include an aligned and threaded cam fastener passage 104. The cam fastener passage 104 preferably receives a threaded shaft fastener 76. The threaded shaft fastener 76 preferably passes initially through the interior end wall and interface aperture 54 of the second end cap interface 18, through the interface rotational shaft 36, through the interior end wall of the rotational shaft receiver 92 and cam fastener passage 104 for the second cam 52. The shaft fastener 76 securely attaches the second end cap interface 18, the spring 86, the second end cap 22, and the second cam 52 to each other. Following the secure attachment of the shaft fastener 76 to the second end cap interface 18, the second cam 52, and the second end cap 22, the entire second end cap assembly may be attached to the second end 14 of the handle 10.

In at least one embodiment the interior end wall of the rotational shaft receiver 93 and the actuator support 97 include an aligned and threaded cam fastener passage 104. The cam fastener passage 104 preferably receives a threaded shaft fastener 76. The threaded shaft fastener 76 preferably passes initially through the interior end wall and interface aperture 54 of the first end cap interface 16, through the interface rotational shaft 37, through the interior end wall of the rotational shaft receiver 93 and cam fastener passage 104 for the first cam 50. The shaft fastener 76 securely attaches the first end cap interface 16, the spring 87, the first end cap 20, and the first cam 50 to each other. Following the secure attachment of the shaft fastener 76 to the first end cap interface 16, the first cam 50, and the first end cap 20, the entire first end cap assembly may be attached to the first end 12 of the handle 10.

In at least one embodiment, the exterior surface of the first end cap 20 and the second end cap 22 are oval/curved in shape towards the exterior of the hybrid drawer handle and release mechanism 6. The first end cap 20 and the second end cap 22 may be curved in shape to facilitate the outward and downward deflection of a dropped item striking the top of the first end cap 20 or second end cap 22, outwardly away from an individual or an individual's feet. The exterior shape and the top of the first and second end caps 20, 22 may be of any shape as desired to deflect dropped items in a desired direction relative to the front of the drawer 7. In some embodiments the first and second end caps 20, 22 may be oval, round, curved, rectangular, square and/or multisided at the preference of an individual.

In at least one embodiment, as may be seen in FIGS. 2 and 19 the cam actuator 98 is similar in shape to a triangular prism where the lower surface is disposed adjacent to and immediately above a latch release lever 110. The upward elevation of the lower grasping edge 28 of the handle 10 provides rotational movement which is translated into downward movement of the lower surface of the cam actuator 98, to depress the cam actuator 98 onto the top of the latch release lever 110. The downward manipulation of the latch release lever 110 in turn releases a latch permitting the drawer 7 to be retracted outwardly from a cabinet into an open position through the use of drawer slides as engaged to the opposite sides of the drawer 7.

In at least one embodiment, as may be seen in FIGS. 2 and 19 the cam actuator 99 is similar in shape to a triangular prism where the lower surface is disposed adjacent to and immediately above a latch release lever 110. The upward elevation of the lower grasping edge 28 of the handle 10 provides rotational movement which is translated into downward movement of the lower surface of the cam actuator 99, to depress the cam actuator 99 onto the top of the latch release lever 110. The downward manipulation of the latch release lever 110 in turn releases a latch permitting the drawer 7 to be retracted outwardly from a cabinet into an open position through the use of drawer slides as engaged to the opposite sides of the drawer 7.

In at least one embodiment as shown in FIG. 12 through FIG. 15, the central support 30 includes a central support flange recess 106 and a central support rotational surface 108. The central support flange recess 106 and central support rotational surface 108 may be generally formed in the shape of a "C".

In some embodiments, the central support 30 is of one-piece construction having a horizontal rear wall 112. The horizontal rear wall 112 is preferably affixed to the front wall 8 of the drawer 7. In at least one embodiment, the central support 30 has a lower angle edge and an upper curved edge to facilitate the use of the hybrid drawer handle and release mechanism 6 with the drawer 7.

In at least one embodiment, the central support 30 may be formed of plastic, wood, metallic materials, fiberglass, composite materials and combinations thereof.

In at least one embodiment the upper portion of the central support 30 is disposed proximate to the top of the handle 10 and the front wall 8. The central support 30 includes a bottom edge which transitions into an angled exterior edge 114 which extends vertically and angularly upward and outwardly from the bottom and terminates at the lower central support rotation surface 108. The central support rotation surface 108 is curved having the same shape as the cylindrical portion 24 of the handle 10. The central support 30 further includes an upper central support rotation surface 108 which is curved having the same shape as the cylindrical portion 24 of the handle 10. The cylindrical portion 24 of the handle 10 is disposed between the lower central support rotation surface 108 and the upper central support rotation surface 108. During use the cylindrical portion 24 may be rotated relative to the lower and upper central support rotation surface 108. The central support flange recess 106 preferably extends rearwardly towards the front wall 8 of the drawer 7 between the lower and upper central support rotation surface 108. The flange 26 of the handle 10 is disposed in the central support flange recess 106 and rotates upwardly and downwardly within the central support flange recess 106 during the elevation and downward release of the handle 10. The central support 30 may also include an outwardly and downwardly arched upper edge 116 which terminates proximate to the upper central support rotation surface 108. In at least one embodiment, during assembly of the second end cap 22, the first step is to place the central portion of the spring 86 over the rotational shaft receiver 92 of the second cam 52. Also the central portion of the spring 87 is placed over the rotational shaft receiver 93 of the first cam 50 for the first end cap 20.

The second step is to insert the second cam 52 and spring 86 into the cam receiving area 72 of the rear portion of the second end cap 22. The rotational shaft receiver 92 is aligned with and is disposed adjacent to the interior of opening 68. In addition, the second end 90 of the spring 86 is engaged to the upper surface of the second cam 52. In some embodiments the engagement of the second end 90 of the spring 86 to the second cam 52 and the insertion and alignment of the rotational shaft receiver 92 with the opening 68 loads the spring 86 and the second cam 52 with an initial amount of at rest tension. Also the first cam 50 and the spring 87 are inserted into the cam receiving area 73 of the rear portion of the first end cap 20. The rotational shaft receiver 93 is aligned with and is disposed adjacent to the interior of opening 69. In addition, the second end 90 of the spring 87 is engaged to the upper surface of the first cam 50. In some embodiments the engagement of the second end 90 of the spring 87 to the first cam 50 and the insertion and alignment of the rotational shaft receiver 93 with the opening 69 loads the spring 87 and the first cam 50 with an initial amount of at rest tension.

The third step is to insert the interface rotational shaft 36 through the opening 68 and into the rotational shaft receiver 92. In this position, the end cap alignment guide 58 will be inserted into the interface positioning depression 56. The circular positioning ring 44 will be exterior and adjacent to the end cap alignment guide 58. The flange receiving slot 40 will be disposed in the flange recess 60. The exterior surface of the cylindrical receiving portion 38 will be disposed adjacent to the end cap rotational surfaces 62. The handle receiving slot 42 will be positioned adjacent to the end cap positioning surface 64. The protrusion members 94 will be disposed within the interface shaft grooves 48. Also the interface rotational shaft 37 is inserted through the opening 69 and into the rotational shaft receiver 93. In this position, the end cap alignment guide 58 will be inserted into the interface positioning depression 56. The circular positioning ring 44 will be exterior and adjacent to the end cap alignment guide 58. The flange receiving slot 41 will be disposed in the flange recess 61. The exterior surface of the cylindrical receiving portion 39 will be disposed adjacent to the end cap rotational surfaces 63. The handle receiving slot 43 will be positioned adjacent to the end cap positioning surface 65. The protrusion members 95 will be disposed within the interface shaft grooves 48.

The fourth step will be to insert the lock cylinder 80 into the lock cylinder opening 78 and to attach the block 82 to the interior end of the lock cylinder 80 positioning the block 82 below the ledge 102 of the L-shaped stop 100. Also the lock cylinder 81 will be inserted into the lock cylinder opening 79 and to attach the block 83 to the interior end of the lock cylinder 81 positioning the block 83 below the ledge 103 of the L-shaped stop 101.

The fifth step will be to insert the second handle end 14 into the handle receiving slot 42, the cylindrical portion 24 into the cylindrical receiving portion 38, and the flange 26 into the flange receiving slot 40, securing the second handle end 14 to the second end cap assembly 22. Also the first handle end 12 will be inserted into the handle receiving slot 43, the cylindrical portion 25 into the cylindrical receiving portion 39, and the flange 27 into the flange receiving slot 41, securing the first handle end 12 to the first end cap assembly 20.

The sixth step involves the placement of the central support 30 adjacent to the front wall 8 approximately equal distances between the first handle end 12 and second handle end 14. Fasteners 71 may then be used for placement from the interior of the drawer 7 outwardly through the front wall 8 and into the horizontal rear wall 112 of the central support 30 at a desired elevation on the front wall 7.

The seventh step involves placement of the flange 26 into the central support flange recess 106 and the positioning of the cylindrical portion 24 adjacent to the central support rotational surface 108.

The eighth step involves the placement of the drawer handle 10 and first and second end caps 20, 22 respectively against the exterior surface of the front wall 8. Fasteners 71 may then be used from the interior of the drawer 7 outwardly through the front wall 8 and into the fastener receivers 70 of the respective first and second end caps 20, 22 to secure the handle 10 and first and second end caps 20, 22 to the front wall 8. In this step, the cam actuators 98, 99 are placed above the respective latch release levers 110. In this step, the access notch 74 may be used to facilitate positioning of the cam actuators 98, 99 above the respective latch release levers 110. Alternatively, the access notch 74 may be used to allow an individual to manipulate the latch release levers 110 downwardly for positioning below the cam actuators 98, 99 and then to release the latch release levers 110 for upward positioning adjacent to the cam actuators 98, 99 when a desired alignment has been obtained.

The latch release levers 110 are engaged to a latch (not shown) which is attached to the respective drawer slides and sides of the cabinet. The upward lifting/elevation of the lower grasping edge 28 transfers rotation motion through the interface rotation shafts 36, 37 and to the rotational shaft receivers 92, 93. In turn, the rotational motion of the first and second cams 50, 52 is translated into downward motion to the cam actuators 98, 99 and onto the top of the latch release levers 110. The downward motion of the cam actuators 98, 99 on the latch release levers 110, disengages the sides of the drawer or the slides of the drawer 7 from the latch and the cabinet, allowing the drawer 7 to be retracted outwardly on the sliding side rails.

The elevation of the lower grasping edge 28 of the handle 10 and rotation of the interface rotation shafts 36, 37 and rotational shaft receivers 92, 93 exerts additional coiling force or tension on the springs 86, 87. Once the drawer 7 has been released from the cabinet and slid outwardly relative thereto, the lower grasping edge 28 of the handle 10 may be released. The release of the handle 10 permits the springs 86, 87 to relieve force or tension an return the lower grasping edge 28 downwardly to the at rest position. Simultaneously to the return of the lower grasping edge 28 from a raised position to a lowered at rest position, the cam actuators 98, 99 return from a downwardly depressed position on the latch release levers 110 to an upper at rest position. In addition, the uncoiling of the springs 86, 87 rotates the rotational shaft receivers 92, 93 and interface rotation shafts 36, 37 in a reverse direction returning to the initial at rest position.

In at least one embodiment, the handle 10 is not required to be manipulated to close a drawer 7 which may be pushed back into a latched position relative to a cabinet. In another embodiment, the lower grasping edge 28 is required to be elevated during the insertion of the drawer 7 into the cabinet to engage the latching assembly.

In a non-locking version of the drawer handle and release mechanism 6 a plug may be used for insertion within the lock cylinder openings 78, 79.

In some embodiments a marker plate may be substituted for a label for attachment to the face of the handle 10. The width between the ridges 32 may be two inches when the face of the drawer 7 is five inches in dimension.

In some embodiments the rear surfaces of the first and second end caps 20, 22 and/or the central support 30 may incorporate a slight recess and a screw chase which allows for the use of either a mechanical fastener, self-tapping screw, or a high strength/bond tape to mount the first and second end caps 20, 22 and/or the central support 30 to the drawer 7.

In some embodiments the first and second end caps 20, 22 encapsulate the first and second cams 50, 52, the shaft fastener 76, as well as the first and second lock cylinders 80, 81 from the environment protecting against corrosion. It should be noted that the shape of the end caps 20, 22 may have any ergonomic shape or esthetic appearance at the preference of an individual.

In a first alternative embodiment, a drawer release mechanism 6 includes a handle 10 having a first end 12, a second end 14, a first cylindrical portion 24 proximate to the first end 12 and a second cylindrical portion 25 proximate to the second end 14, a grasping edge 28 extending between the first end 12 and the second end 14 and a first flange portion 26 extending outwardly and rearwardly from the cylindrical portion proximate to the first end, and a second flange portion 27 extending outwardly and rearwardly from the cylindrical portion 24 proximate to the second end 14, a first end cap interface 16 engaged to the first end 12 and a second end cap interface 18 engaged to the second end 14, the first end cap interface 16 having a first interface rotational shaft 36, a first cylindrical receiving portion 38 opposite to the first interface rotational shaft 36, a first handle receiving slot 42, and a first flange receiving slot 40, the first cylindrical receiving portion 38 releasably engaging the first cylindrical portion 24, the first handle receiving slot 42 releasably engaging a portion of the first end 12, and the first flange receiving slot 40 releasably engaging the first flange portion 26, the second end cap interface 18 having a second interface rotational shaft 37, a second cylindrical receiving portion 39 opposite to the second interface rotational shaft 36, a second handle receiving slot 43, and a second flange receiving slot 41, the second cylindrical receiving portion 39 releasably engaging the second cylindrical portion 25, the second handle receiving slot 43 releasably engaging a portion of the second end 14, and the second flange receiving slot 40 releasably engaging the second flange portion 27, a first end cap 20 proximate and exterior to the first end cap interface 16, the first end cap 20 having a first end cap flange recess 60, a first end cap rotation surface 62, a first shaft opening 68, and a first rear cam receiving area 72, the first interface rotational shaft 36 being disposed through the first shaft opening 68, the first cylindrical receiving portion 38 being positioned adjacent to the first end cap rotation surface 62 and the first flange receiving slot 40 being disposed in the first end cap flange recess 60, a second end cap 22 proximate and exterior to the second end cap interface, the second end cap having a second end cap flange recess, a second end cap rotation surface 18, a second shaft opening 69, and a second rear cam receiving area 73, the second interface rotational shaft 37 being disposed through the second shaft opening 69, the second cylindrical receiving portion 39 being positioned adjacent to the second end cap rotation surface 63 and the second flange receiving slot 41 being disposed in the second end cap flange recess 61, the first end cap 20 and the second end cap 22 being constructed and arranged for attachment to the front wall 8 of a drawer 7, a first cam 50, the first cam 50 having a first rotational shaft receiver 92, a first actuator support 96, and a first cam actuator 98 extending outwardly from the first actuator support 96 opposite to the first rotational shaft receiver 92, the first cam 50 being disposed in the first rear cam receiving area 72, the first interface rotational shaft 36 being disposed in the first rotational shaft receiver 92, a second cam 52, the second cam 52 having a second rotational shaft receiver 93, a second actuator support 97, and a second cam actuator 99 extending outwardly from the second actuator support 97 opposite to the second rotational shaft receiver 93, the second cam 52 being disposed in the second rear cam receiving area 73, the second interface rotational shaft 37 being disposed in the second rotational shaft receiver 93, and a first spring 86 engaged to the first cam 50 and to the first rear cam receiving area 72 and a second spring 87 engaged to the second cam 52 and to the second rear cam receiving area 73.

In a second alternative embodiment according to the first alternative embodiment, the first end cap interface 16 and the second end cap interface 18 are reverse elements relative to each other, the first end cap 20 and the second end cap 22 are reverse elements relative to each other, and the first cam 50 and the second cam 52 are reverse elements relative to each other.

In a third alternative embodiment according to the second alternative embodiment, the drawer release mechanism 6 further comprises a central support 30, the central support being constructed and arranged for attachment to the front wall 8 of the drawer 7 between the first end 12 and the second end 14, the central support 30 having a rear wall 112, a central support flange recess 106 and a central support rotation surface 108, the central support flange recess 106 rotatably receiving a portion of the first flange 26 or the second flange 27, and the central support rotation surface 108 rotatably receiving a portion of the first cylindrical portion 24 or the second cylindrical portion 25.

In a fourth alternative embodiment according to the third alternative embodiment the first end cap 50 further comprises a first interior vertical wall 118, a first intermediate vertical wall 120 and a first exterior vertical wall 122, wherein the first shaft opening 68 passes through the first intermediate vertical wall 120, the first end cap flange recess 60 and the first end cap rotation surface 62 are disposed between the first interior vertical wall 118 and the first intermediate vertical wall 120, the first end cap 50 having a first end cap positioning surface 64 below the first end cap rotation surface 62, and further wherein the first rear cam receiving area 72 is located rearwardly of a first end cap front face 124 between the first exterior vertical wall 122 and the first intermediate vertical wall 120.

In a fifth alternative embodiment according to the fourth alternative embodiment, the second end cap 52 further comprising a second interior vertical wall 126, a second intermediate vertical wall 128 and a second exterior vertical wall 130, wherein the second shaft opening passes 69 through the second intermediate vertical wall 128, the second end cap flange recess 61 and the second end cap rotation surface 63 are disposed between the second interior vertical wall 126 and the second intermediate vertical wall 128, the second end cap 52 having a second end cap positioning surface 65 below the second end cap rotation surface 63, and further wherein the second rear cam receiving area 73 is located rearwardly of a second end cap front face 132 between the second exterior vertical wall 130 and the second intermediate vertical wall 128.

In a sixth alternative embodiment according to the fifth alternative embodiment, the first cam 50 further comprises a first stop 100 having a first ledge 102, the first stop 100 descending from at least one of the first rotational shaft receiver 92, the first actuator support 96 and the first cam actuator 98.

In a seventh alternative embodiment according to the sixth alternative embodiment, the second cam 52 further comprises a second stop 101 having a second ledge 103, the second stop 101 descending from at least one of the second rotational shaft receiver 93, the second actuator support 97 and the second cam actuator 99.

In an eighth alternative embodiment according to the seventh alternative embodiment, the first end cap 50 has a first lock opening 78 disposed through the first end cap front face 124, the first lock opening 78 receiving a first lock 80, the first lock 80 having a first block surface 82, the first lock 80 having a first locking position wherein the first block surface 82 is disposed proximate to and below the first ledge 102, the first lock 80 having a first unlocked position wherein the first block surface 82 is rotated downwardly away from the first ledge 102.

In a ninth alternative embodiment according to the eighth alternative embodiment, the second end cap 52 has a second lock opening 79 disposed through the second end cap front face 132, the second lock opening 79 receiving a second lock 81, the second lock 81 having a second block surface 83, the second lock 81 having a second locking position wherein the second block surface 83 is disposed proximate to and below the second ledge 103, the second lock 81 having a second unlocked position wherein the second block surface 83 is rotated downwardly away from the second ledge 103.

In a tenth alternative embodiment according to the ninth alternative embodiment, the first cam actuator 98 is positioned proximate to and above a first latch release lever 110 and the second cam actuator 99 is positioned proximate to and above a second latch release lever 111.

In an eleventh alternative embodiment according to the tenth alternative embodiment, rotation of the handle 10 upwardly from an at rest position moves the first cam actuator 98 downwardly against the first latch release lever 110 and moves the second cam actuator 99 downwardly against the second latch release lever 111.

In a twelfth alternative embodiment according to the eleventh alternative embodiment, the first handle receiving slot 42 has a first interior handle receiving slot surface 134 and the second handle receiving slot 43 has a second interior handle receiving slot surface 136 and further wherein in the at rest position the first interior handle receiving slot surface 134 is disposed proximate to the first end cap positioning surface 64 and the second interior handle receiving slot surface 136 is disposed proximate to the second end cap positioning surface 65.

In a thirteenth alternative embodiment according to the twelfth alternative embodiment, the first flange recess 60 has a first upper rotational stop edge 138 and a first lower rotational stop edge 140 and the second flange recess 61 has a second upper rotational stop edge 142 and a second lower rotational stop edge 144.

In a fourteenth alternative embodiment according to the thirteenth alternative embodiment, the central support flange recess 106 has a support upper rotational stop edge 146 and a support lower rotational stop edge 148.

In a fifteenth alternative embodiment according to the fourteenth alternative embodiment, the rear wall 112 is horizontal.

In a sixteenth alternative embodiment according to the fifteenth alternative embodiment, the first end cap front face 124 and the second end cap front face 132 have an identical shape.

In a seventeenth alternative embodiment according to the sixteenth alternative embodiment, said shape is rectangular.

In an eighteenth alternative embodiment according to the seventeenth alternative embodiment, the shape is oval.

In a nineteenth alternative embodiment according to the eighteenth alternative embodiment, the shape is bullet shaped.

In a twentieth alternative embodiment according to the nineteenth alternative embodiment, the handle 10 has at least two outwardly extending ridges 32 defining a handle channel 34, the handle channel 34 being constructed and arranged for receipt of a label.

The above disclosure is intended to be illustrative and not exhaustive. This description will suggest many variations and alternatives to one of ordinary skill in this art. The various elements shown in the individual figures and described above may be combined or modified for combination as desired. All these alternatives and variations are intended to be included within the scope of the claims where the term "comprising" means "including, but not limited to".

These and other embodiments which characterize the invention are pointed out with particularity in the claims annexed hereto and forming a part hereof. However, for further understanding of the invention, its advantages and objectives obtained by its use, reference should be made to the drawings which form a further part hereof and the accompanying descriptive matter, in which there is illustrated and described embodiments of the invention.

I claim:

1. A drawer release mechanism comprising:

a handle having a first end, a second end, a cylindrical portion extending between said first end and said second end, and a first flange portion extending outwardly and rearwardly from said cylindrical portion proximate to said first end and a second flange portion extending outwardly and rearwardly from said cylindrical portion proximate to said second end;

a first end cap interface engaged to said first end and a second end cap interface engaged to said second end, said first end cap interface having a first interface rotational shaft, a first handle receiving slot, and a first flange receiving slot, said first handle receiving slot releasably engaging a portion of said first end, and said first flange receiving slot releasably engaging said first flange portion, said second end cap interface having a second interface rotational shaft, a second handle receiving slot, and a second flange receiving slot, said second handle receiving slot releasably engaging a portion of said second end, and said second flange receiving slot releasably engaging said second flange portion;

a first end cap proximate and exterior to said first end cap interface, said first end cap having a first end cap flange recess, a first end cap rotation surface, a first shaft opening, and a first rear cam receiving area, said first interface rotational shaft being disposed through said first shaft opening, and said first flange receiving slot being disposed in said first end cap flange recess, a second end cap proximate and exterior to said second end cap interface, said second end cap having a second end cap flange recess, a second end cap rotation surface, a second shaft opening, and a second rear cam receiving area, said second interface rotational shaft being disposed through said second shaft opening, and said second flange receiving slot being disposed in said second end cap flange recess, said first end cap and said second end cap being constructed and arranged for attachment to the front wall of a drawer;

a first cam, said first cam having a first rotational shaft receiver and a first cam actuator extending outwardly from said first rotational shaft receiver, said first cam being disposed in said first rear cam receiving area, said first interface rotational shaft being disposed in said first rotational shaft receiver, a second cam, said second cam having a second rotational shaft receiver and a second cam actuator extending outwardly from said second rotational shaft receiver, said second cam being disposed in said second rear cam receiving area, said second interface rotational shaft being disposed in said second rotational shaft receiver; and a first spring engaged to said first cam and to said first rear cam receiving area and a second spring engaged to said second cam and to said second rear cam receiving area.

2. The drawer release mechanism according to claim 1, wherein said first end cap interface and said second end cap interface are reverse elements relative to each other, said first end cap and said second end cap are reverse elements relative to each other, and said first cam and said second cam are reverse elements relative to each other.

3. The drawer release mechanism according to claim 2, further comprising a central support, said central support being constructed and arranged for attachment to said front wall of said drawer between said first end and said second end, said central support having a rear wall, a central support flange recess and a central support rotation surface, said central support flange recess rotatably receiving a portion of said first flange or said second flange, and said central support rotation surface rotatably receiving a portion of said cylindrical portion.

4. The drawer release mechanism according to claim 3, said first end cap further comprising a first interior vertical wall, a first intermediate vertical wall and a first exterior vertical wall, wherein said first shaft opening passes through said first intermediate vertical wall, said first end cap flange recess and said first end cap rotation surface are disposed between said first interior vertical wall and said first intermediate vertical wall, said first end cap having a first end cap positioning surface below said first end cap rotation surface, and further wherein said first rear cam receiving area is located rearwardly of a first end cap front face between said first exterior vertical wall and said first intermediate vertical wall.

5. The drawer release mechanism according to claim 4, said second end cap further comprising a second interior vertical wall, a second intermediate vertical wall and a second exterior vertical wall, wherein said second shaft opening passes through said second intermediate vertical wall, said second end cap flange recess and said second end cap rotation surface are disposed between said second interior vertical wall and said second intermediate vertical wall, said second end cap having a second end cap positioning surface below said second end cap rotation surface, and further wherein said second rear cam receiving area is located rearwardly of a second end cap front face between said second exterior vertical wall and said second intermediate vertical wall.

6. The drawer release mechanism according to claim 5, said first cam further comprising a first stop having a first ledge, said first stop descending from at least one of said first rotational shaft receiver and said first cam actuator.

7. The drawer release mechanism according to claim 6, said second cam further comprising a second stop having a second ledge, said second stop descending from at least one of said second rotational shaft receiver and said second cam actuator.

8. The drawer release mechanism according to claim 7, said first end cap having a first lock opening disposed through said first end cap front face, said first lock opening receiving a first lock, said first lock having a first block surface, said first lock having a first locking position wherein said first block surface is disposed proximate to and below said first ledge, said first lock having a first unlocked position wherein said first block surface is rotated downwardly away from said first ledge.

9. The drawer release mechanism according to claim 8, said second end cap having a second lock opening disposed through said second end cap front face, said second lock opening receiving a second lock, said second lock having a second block surface, said second lock having a second locking position wherein said second block surface is disposed proximate to and below said second ledge, said second lock having a second unlocked position wherein said second block surface is rotated downwardly away from said second ledge.

10. The drawer release mechanism according to claim 9, wherein said first cam actuator is positioned proximate to and above a first latch release lever and said second cam actuator is positioned proximate to and above a second latch release lever.

11. The drawer release mechanism according to claim 10, wherein rotation of said handle upwardly from an at rest position moves said first cam actuator downwardly against said first latch release lever and moves said second cam actuator downwardly against said second latch release lever.

12. The drawer release mechanism according to claim 11, wherein said first handle receiving slot has a first interior handle receiving slot surface and said second handle receiving slot has a second interior handle receiving slot surface and further wherein in said at rest position said first interior handle receiving slot surface is disposed proximate to said first end cap positioning surface and said second interior handle receiving slot surface is disposed proximate to said second end cap positioning surface.

13. The drawer release mechanism according to claim 12, wherein said first flange recess has a first upper rotational stop edge and a first lower rotational stop edge and said second flange recess having a second upper rotational stop edge and a second lower rotational stop edge.

14. The drawer release mechanism according to claim 13, wherein said central support flange recess has a support upper rotational stop edge and a support lower rotational stop edge.

15. The drawer release mechanism according to claim 14, wherein said rear wall is horizontal.

16. The drawer release mechanism according to claim 15, wherein said first end cap front face and said second end cap front face have an identical shape.

17. The drawer release mechanism according to claim 16, wherein said shape is rectangular.

18. The drawer release mechanism according to claim 16, wherein said shape is oval.

19. The drawer release mechanism according to claim 16, wherein said shape is bullet shaped.

20. The drawer release mechanism according to claim 15, said handle having at least two outwardly extending ridges defining a handle channel, said handle channel being constructed and arranged for receipt of a label.

21. A drawer release mechanism comprising:

a handle having a first end, a second end;

a first end cap interface engaged to said first end and a second end cap interface engaged to said second end, said first end cap interface having a first interface rotational shaft, a first handle receiving area, said first handle receiving area releasably engaging a portion of said first end, said second end cap interface having a second interface rotational shaft, a second handle receiving area, said second handle receiving area releasably engaging a portion of said second end;

a first end cap proximate and exterior to said first end cap interface, said first end cap having a first shaft opening and a first cam receiving area, said first interface rotational shaft being disposed through said first shaft opening, a second end cap proximate and exterior to said second end cap interface, said second end cap having a second shaft opening and a second cam receiving area, said second interface rotational shaft being disposed through said second shaft opening, said first end cap and said second end cap being constructed and arranged for attachment to the front wall of a drawer;

a first cam, said first cam having a first rotational shaft receiver, and a first cam actuator extending outwardly from said first cam, said first cam being disposed in said first cam receiving area, said first interface rotational shaft being disposed in said first rotational shaft receiver, a second cam, said second cam having a second rotational shaft receiver, and a second cam actuator extending outwardly from said second cam, said second cam being disposed in said second cam receiving area, said second interface rotational shaft being disposed in said second rotational shaft receiver; and a first spring engaged to said first cam and to said first cam receiving area and a second spring engaged to said second cam and to said second cam receiving area.

* * * * *